US007021998B2

(12) United States Patent
Umemura et al.

(10) Patent No.: US 7,021,998 B2
(45) Date of Patent: Apr. 4, 2006

(54) METHOD AND DEVICE FOR FINISHING SURFACE OF LONG MATERIAL

(75) Inventors: Mitsugi Umemura, Toyokawa (JP); Takayuki Nakada, Toyokawa (JP)

(73) Assignee: Sintokogio, Ltd., Aichi-ken (JP)

( * ) Notice: Subject to any disclaimer, the term of this patent is extended or adjusted under 35 U.S.C. 154(b) by 132 days.

(21) Appl. No.: 10/332,500

(22) PCT Filed: Jul. 9, 2001

(86) PCT No.: PCT/JP01/05929

§ 371 (c)(1),
(2), (4) Date: Jun. 30, 2003

(87) PCT Pub. No.: WO02/04170

PCT Pub. Date: Jan. 17, 2002

(65) Prior Publication Data

US 2004/0023603 A1 Feb. 5, 2004

(30) Foreign Application Priority Data

| | | |
|---|---|---|
| Jul. 11, 2000 | (JP) | 2000-209398 |
| Apr. 18, 2001 | (JP) | 2001-119553 |
| Apr. 27, 2001 | (JP) | 2001-130520 |
| Jun. 6, 2001 | (JP) | 2001-170915 |

(51) Int. Cl.
*B24B 1/00* (2006.01)

(52) U.S. Cl. ..... 451/59; 451/194; 451/302

(58) Field of Classification Search ..... 451/59, 451/168, 194, 302, 303, 132, 133, 199, 195, 451/207, 262, 264, 112, 113
See application file for complete search history.

(56) References Cited

U.S. PATENT DOCUMENTS

| | | | | |
|---|---|---|---|---|
| 3,203,139 | A * | 8/1965 | Giese | 451/57 |
| 3,540,168 | A * | 11/1970 | Sawert | 451/36 |
| 5,899,794 | A * | 5/1999 | Shige et al. | 451/41 |
| 6,238,273 | B1 * | 5/2001 | Southwick | 451/41 |
| 6,632,547 | B1 * | 10/2003 | Shimada | 428/694 SG |

FOREIGN PATENT DOCUMENTS

| | | |
|---|---|---|
| JP | 59-169762 | 9/1984 |
| JP | 61-121866 | 6/1986 |
| JP | 64-16367 | 1/1989 |

* cited by examiner

*Primary Examiner*—Dung Van Nguyen
(74) *Attorney, Agent, or Firm*—Finnegan Henderson, Farabow, Garrett & Dunner, L.L.P.

(57) ABSTRACT

An inline-ready method of finishing the surface of a long material (W) capable of preventing any environmental problem from occurring and the mechanical properties of the long material from deteriorating, comprising the steps of holding the long material (W) by two or more elastic endless belts (1) with a specified force, rotating the elastic endless belts (1) in the same direction as or in the reverse direction to the moving direction of the long material by moving the long material (W) and increasing or decreasing the rotating speed of the elastic endless belts (1) more than or less than the moving speed of the long material, and loading powder and granular grinding material (S) between the elastic endless belts (1), characterized in that the grinding material (S) is moved relative to the long material (W) to rub the grinding material (S) against the long material (W) so as to finish the surface of the long material (W).

11 Claims, 13 Drawing Sheets

METHOD AND DEVICE FOR FINISHING SURFACE OF LONG MATERIAL

TECHNICAL FIELD

This invention relates to a method and apparatus for processing or finishing the surface of a long piece of material that forms a circle, a round shape, a polygon or an odd shape in section. It relates more particularly to a suitable method and apparatus for surface treatment such as removing oxide scale, rust, foreign matter or burrs, surface roughening, surface grinding, rounding or the like.

BACKGROUND ART

When the surface of the above-mentioned long piece of material is processed by using a cutting tool, a cutting wheel, a brush, a belt sander, etc., especially when the material is a wire rod with a small cross section, it is very difficult to continuously and uniformly cut its periphery. For this reason, the oxide scale or rust on a wire rod is removed by washing it out with acid or is peeled by using a die or the like (for example, see JP No. 28-57279), and extraneous matter is removed by washing it out with alkali or organic solvent.

However, there were problems in that when acid is used for the washing, the use of a lot of water that is needed as an environmental countermeasure to process the waste water results in an expensive large-scale equipment; when processing thin wire rods, they tend to mutually contact and thus it is difficult to uniformly dip and process the entire wire rod; and when a long piece of material of iron is processed, its mechanical quality could be reduced depending on the used acid (chemicals). When once the washing operation by acid water in the above-mentioned large-scale equipment is interrupted, the long piece of material being processed tends to be excessively dipped in acid so that its surface could severely be deteriorated. Thus, it was difficult to realize an in-line large-scale processing apparatus for washing by acid.

There have been harmful effects in that when extraneous matter is removed by having a long piece of material pass between cutting tools such as a composite blade or die, a trace of cutting tools remains on the long piece of material or a thin wire rod is cut due to tension caused by cutting resistance.

There have been problems in that when a material is washed by alkali or organic solvent, it is very troublesome to manage chemical solutions used similarly to washing by acid in terms of protection against the working environment, and in that a large-scale apparatus is also inevitable for the wet method.

DISCLOSURE OF INVENTION

This invention is made considering the above circumstances. The purpose of this invention is to provide a method and apparatus for surface processing a long piece of material that can be used as in-line means without any environmental problem or any degradation in the mechanical quality of the long piece of material being produced.

In accordance with one aspect of this invention, to achieve the above purpose the method of surface processing a long piece of material comprises the steps of holding a long piece of material between two or more elastic endless belts or elastic rollers, rotating the endless belts in the same direction as or opposite to the direction of the moving material such that the speed of rotation of the elastic endless belts is kept faster or slower than the speed of movement of the long piece of material while the long piece of material is being moved, and putting a powder/particle-like polishing material between said elastic endless belts, characterized thereby by moving the polishing material relatively to said long piece of material to rub and surface finish the long piece of material.

In this aspect, the elastic endless belts (or elastic rollers) used in this invention may be of any size, shape, or quality of material, so long as they can hold polishing material between the belts or rollers and the long piece of material, have a strength that can withstand the frictional force generated when the long piece of material passes therethrough, and can be rotated by a motor. A plurality of grooves for holding a polishing material, which are disposed on the surface of the elastic endless belts and extend in a direction perpendicular to the belts, can be provided.

In this invention the magnitude of the force for two or more elastic endless belts to hold a long piece of material between them is such that the elastic endless belts can rotate while the long piece of material is being held between them. Further, the elastic endless belts surface finish the long piece of material abrasively by moving the polishing material relative to the long piece of material: the speed of rotation of the elastic endless belts is adjusted so that it becomes slower or faster than that of the movement of the long piece of material while keeping the latter moving.

In accordance with another aspect of this invention, the method of surface processing a given length of a long piece of material comprises the steps of holding a long piece of material between powder/particle-like abrasives contained in a flexible container by a given strength and rotating a flexible container around the longitudinal centerline of the long piece of material while the long piece of material is being kept moving, thereby surface finishing the long piece of material by moving the long piece of material relatively to the abrasives.

In this aspect a flexible hollow container of any size or material may be used for this invention so long as it can hold powder/particle-like abrasives, and can be elastically deformed in corresponence to the pressure from the outside. However, when a long piece of material is continuously processed, the container must be equipped with a pair of openings through which abrasives are supplied to and discharged from the container. Further, compressed air may be circulated in the container to avoid heating the abrasives.

In accordance with a further aspect of this invention, the method of surface processing of this invention comprises holding a long piece of material in a container supplied with abrasives so that the long piece of material can freely pass therethrough to have it contact the abrasives, and circulating a gaseous fluid in the container so as to discharge a fine powder or fragments that are generated by the contact with the container. In this aspect, a container of any size, shape, or material can be used so long as it can hold a powder/particle substance. However, when a wire rod is continuously processed, preferably the container is equipped with a pair of openings in its front/back or upper/lower parts so that the wire rod can pass therethrough to be effectively and continuously processed.

When pressure is applied to a powder/particle material, the strength of the container must be increased accordingly. In this case, the container may be equipped with a chamber or the container itself may have a flexible structure. Further, a low-temperature inactive gas may be introduced into the container to avoid heating the powder/particle material.

The type of the long piece of material that is suitable for this invention has a uniform cross section and a surface with no difference in level in the axial direction. This is because especially when pressure is applied to a long piece of material with a difference in level, a powder/particle substance could gather in the recessed portions in its progressing direction to interrupt the surface processing.

In this invention a plurality of long pieces of material can be passed at one time through the container with the powder/particle substance. In this case, the container is equipped with two or more pairs of openings.

A soft abrasive used in this invention is a simple substance of a plant such as chaff, leaves of aspera, a scouring rush or the like, or a mixture thereof. These abrasives are suitable for light surface finishing or for removing extraneous matter. Further, a hard abrasive used in this invention is a simple substance of alumina, ceramics, glass powder, nonferrous powder, metal powder or the like or a mixture thereof. These abrasives are suitable for a powerful process such as removing oxide scale, rust, extraneous matter, burrs from a long piece of material or rounding the long piece of material. An abrasive made by mixing the soft and hard abrasives is suitable for lightly or moderately grinding the surface of a long piece of material.

The size of the abrasive used in this invention is determined by the correlation between the abrasive and a dimension of a long piece of material such as its cross section or the like: an abrasive with a particle diameter of 0.02–2.50 mm is easily supplied into a container, and effectively removes extraneous matter from the surface of a long piece of material. Further, the function of surface processing can be heightened by wetting the elastic endless belts.

Although in this invention a long piece of material is fundamentally held by pressing it from two opposing directions, it may be held by pressing it from three directions. Further, when a long piece of material has not been adequately processed in an expected substantially uniform shape, it may be reprocessed after the positions to be pressed are changed by a given angle.

BRIEF DESCRIPTIONS OF DRAWINGS

Figure 8:
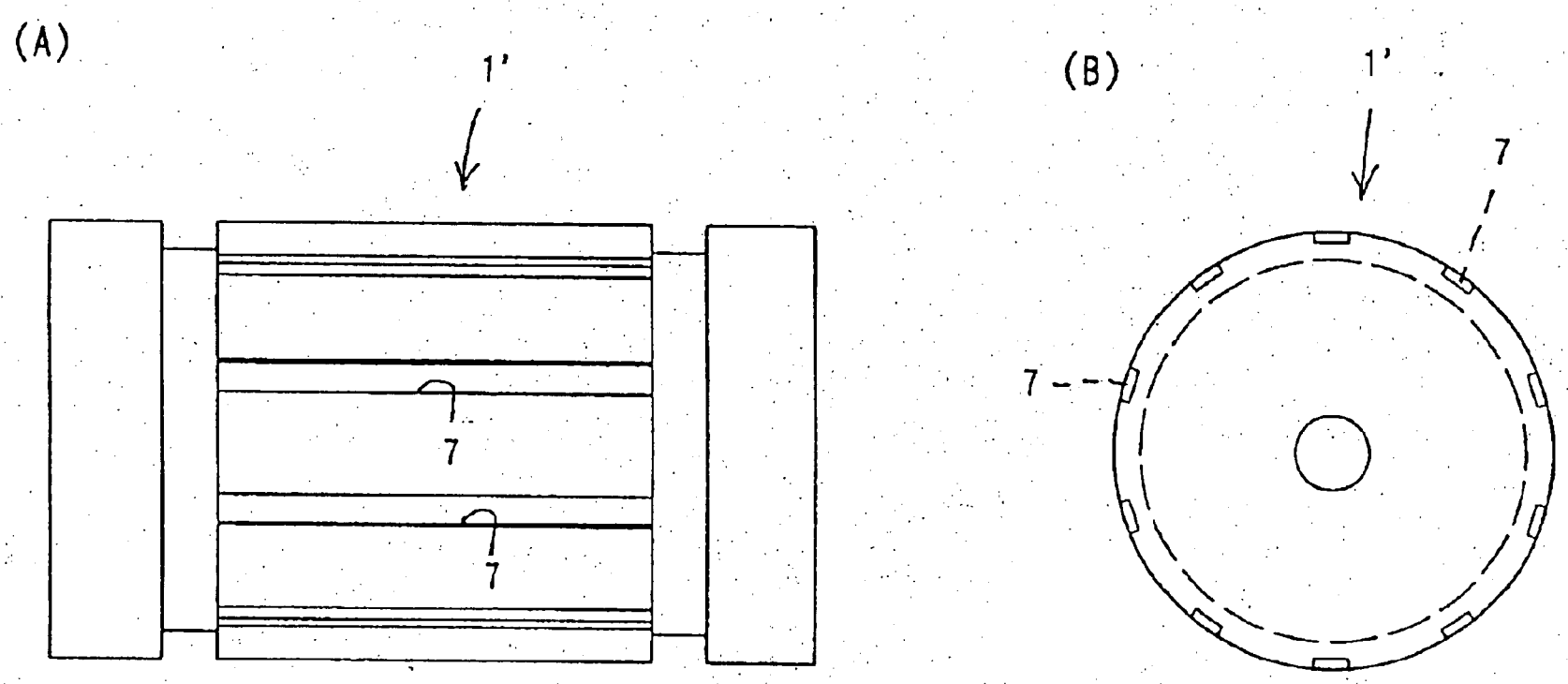

FIG. 8-A is a front view and 8-B is a right side view to show a second embodiment of the elastic roller of this invention.

Figure 6:
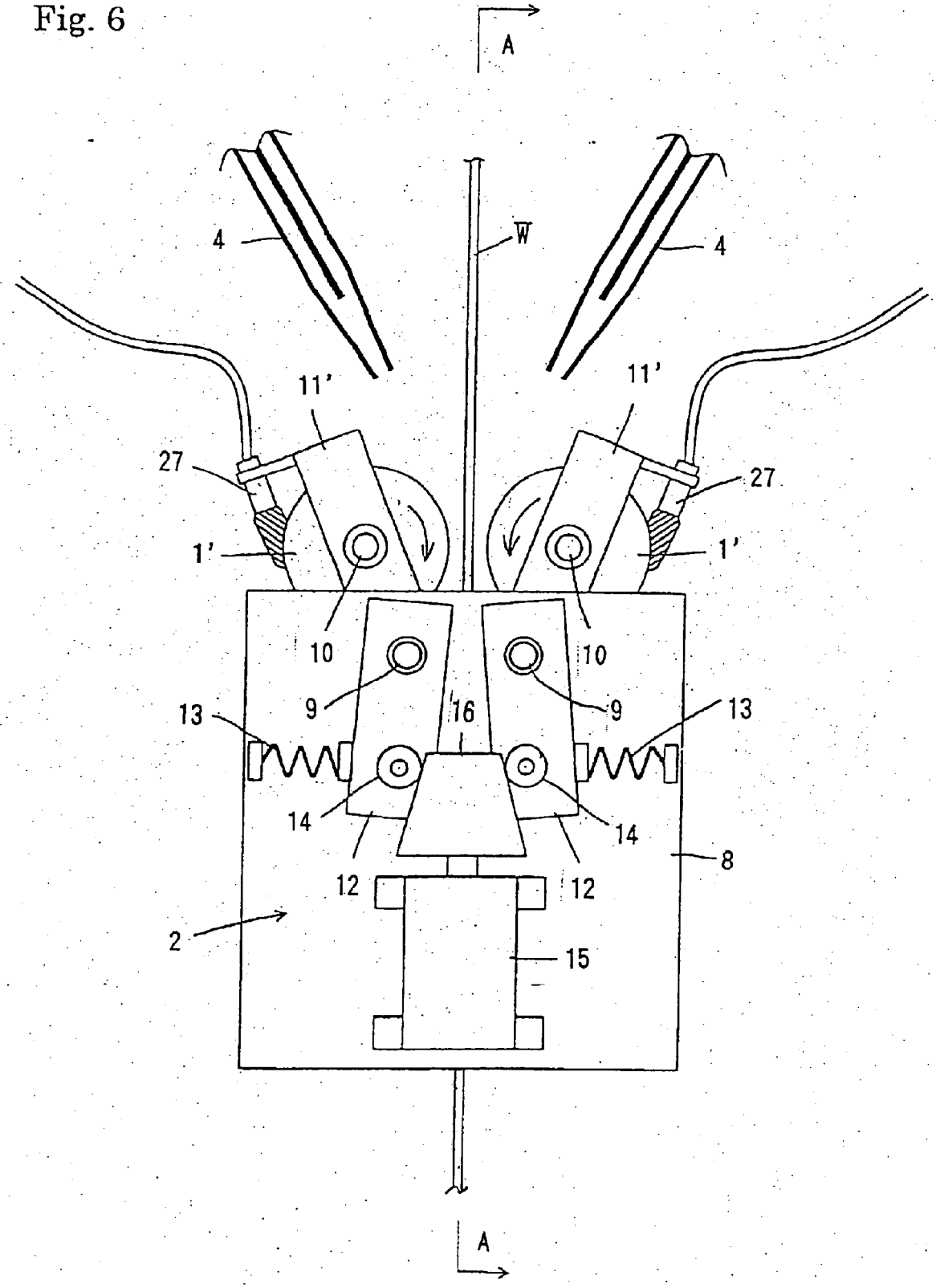
FIG. 6 is a right side view of the main part of FIG. 5.
Figure 9:
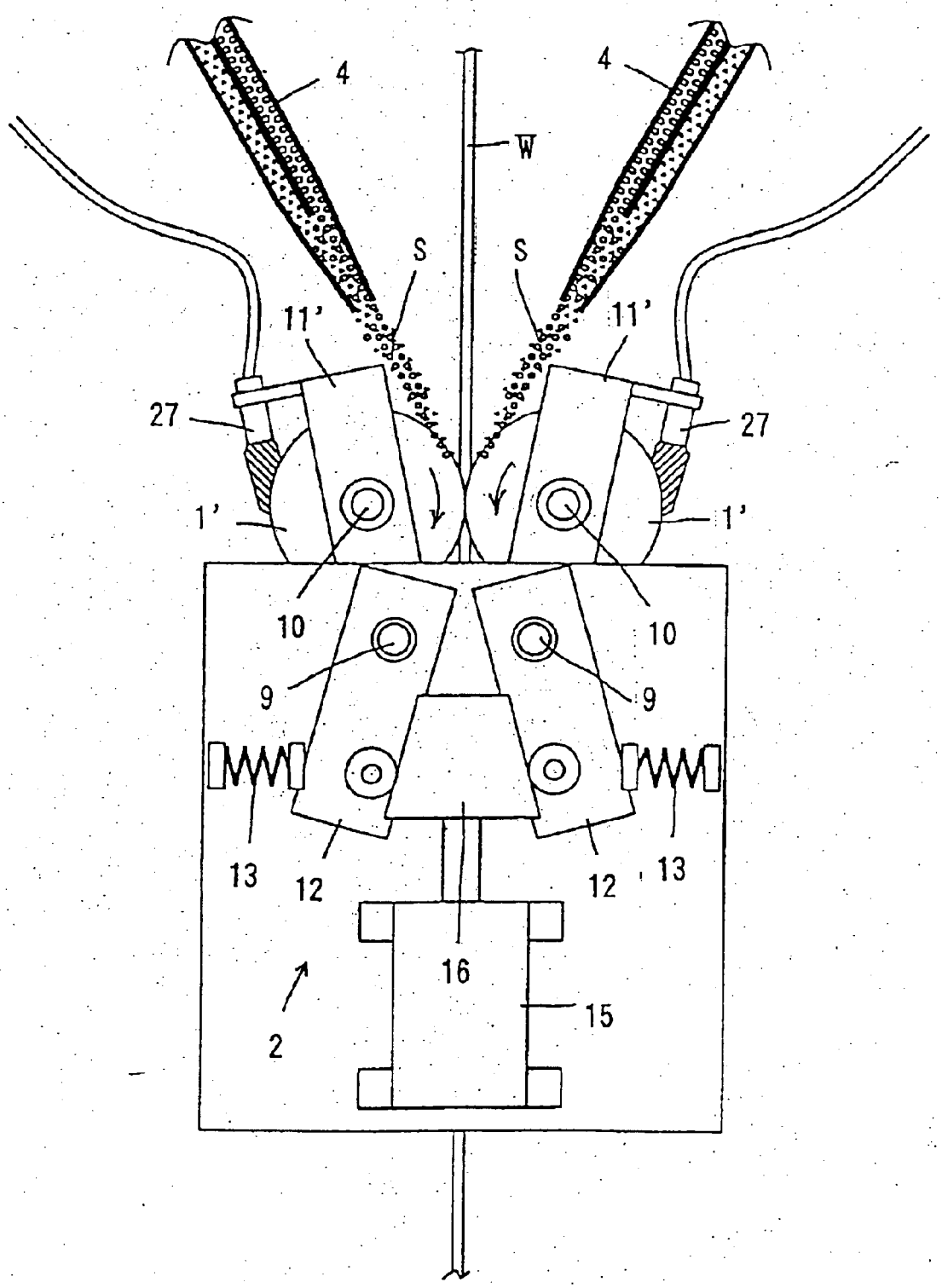

FIG. 9 is a schematic to explain the operation of surface processing the wire rod of FIG. 6.

Figure 10:
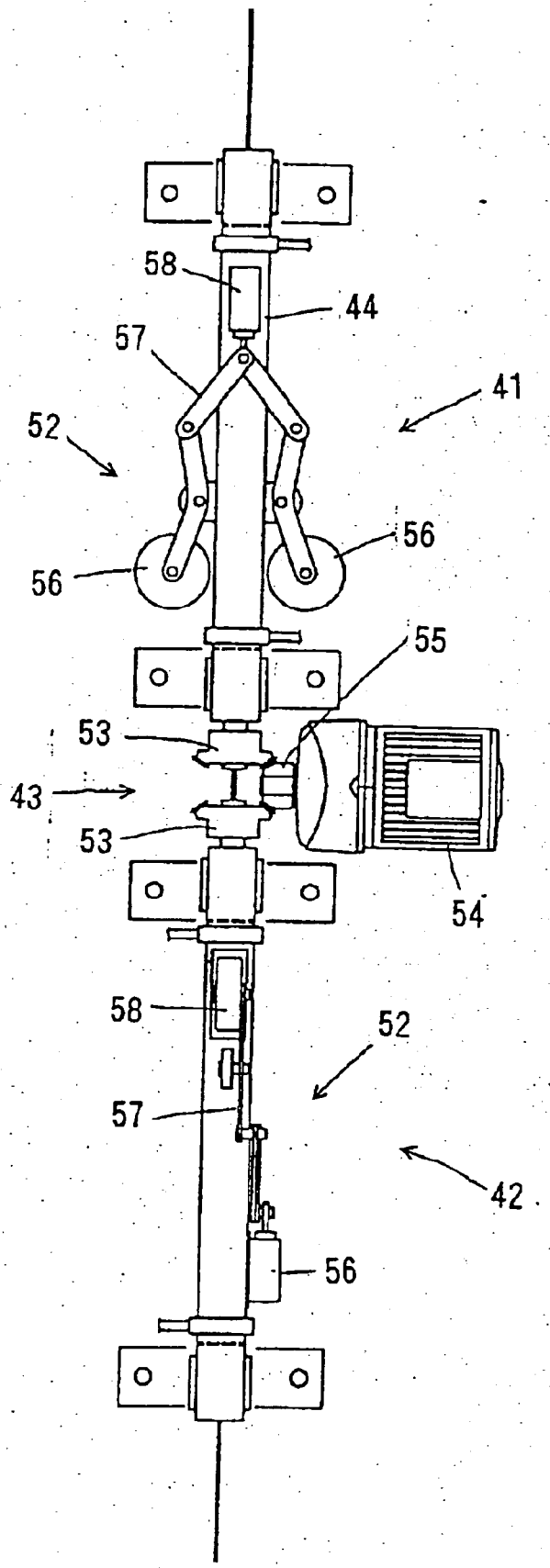

FIG. 10 is a front view to show the outside of a third embodiment of this invention.

Figure 11:
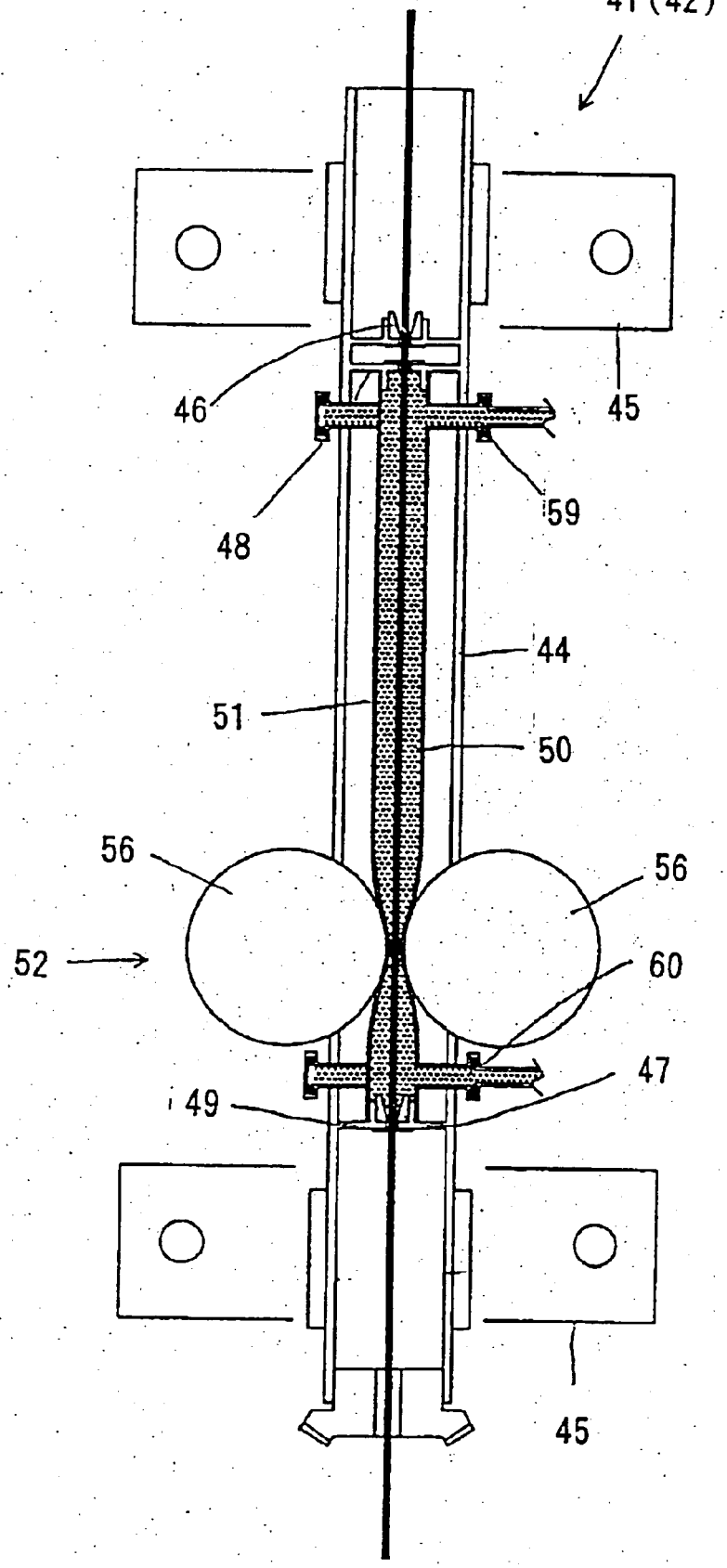

FIG. 11 is a front view with a partial cross section to show the main part of the third embodiment of this invention.

Figure 12:
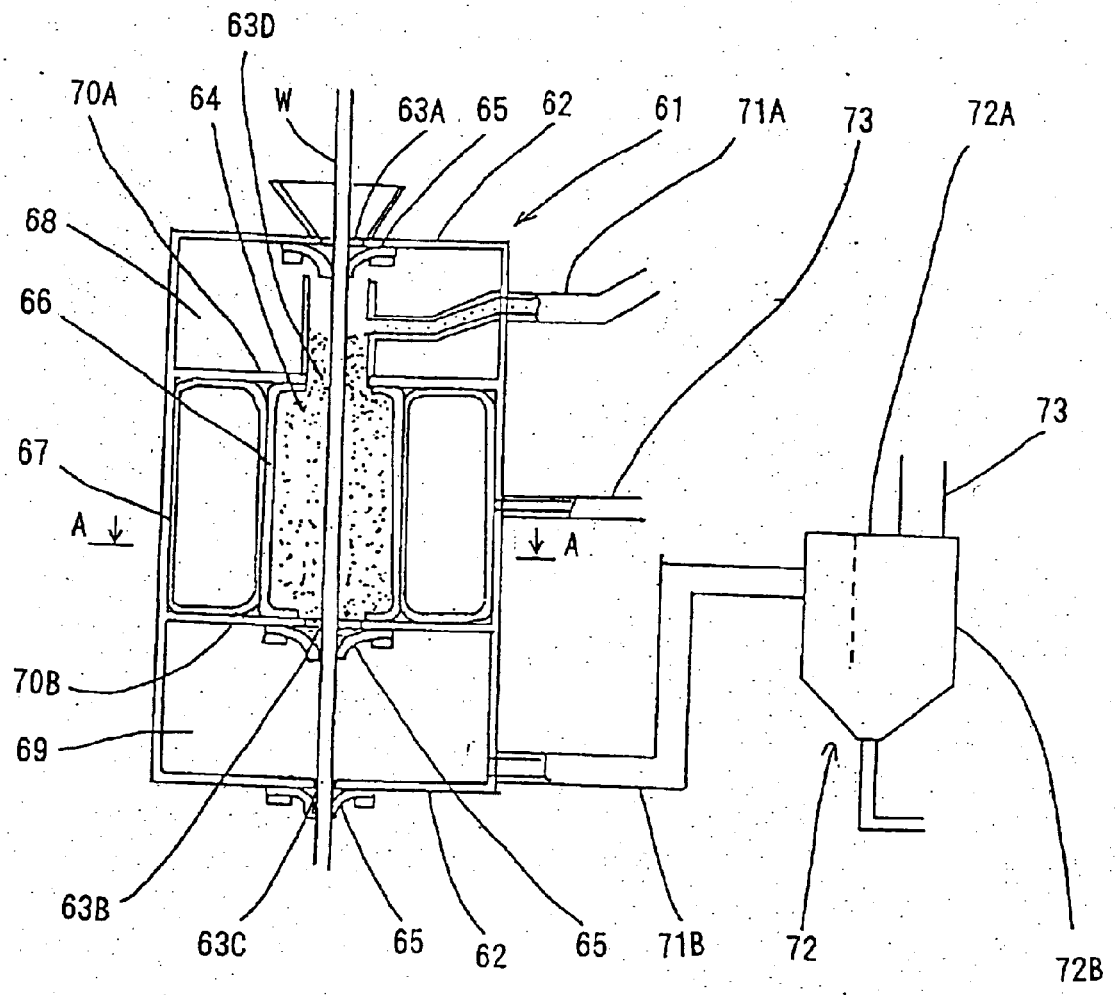

FIG. 12 is a schematic to explain the constitution of a fourth embodiment of this invention.

Figure 13:
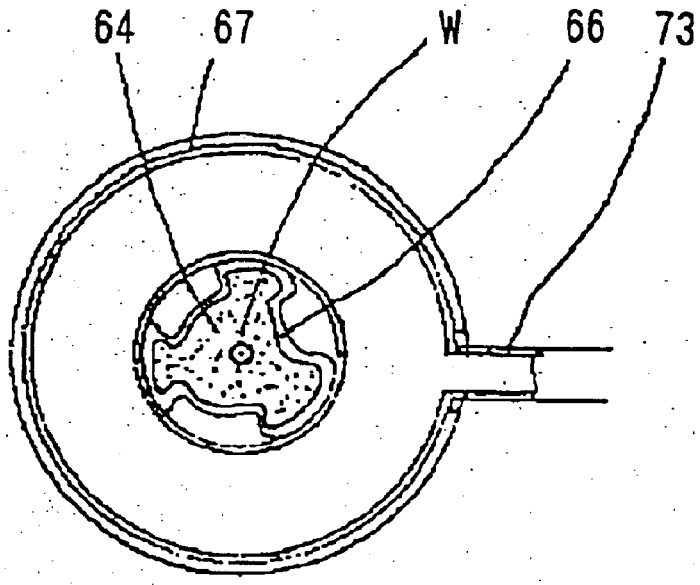

FIG. 13 is a schematic of a cross section of FIG. 12 cut along the line A—A to explain the constitution of the fourth embodiment of this invention before pressure is applied thereto.

Figure 14:
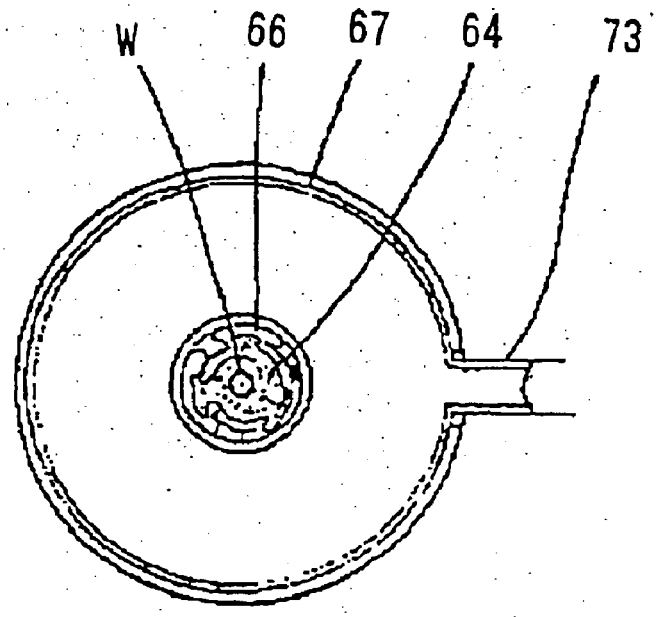

FIG. 14 is a schematic of a cross section of FIG. 12 cut along the line A—A to explain the constitution of the fourth embodiment of this invention after pressure is applied thereto.

PREFERRED EMBODIMENTS OF INVENTION

Figure 1:
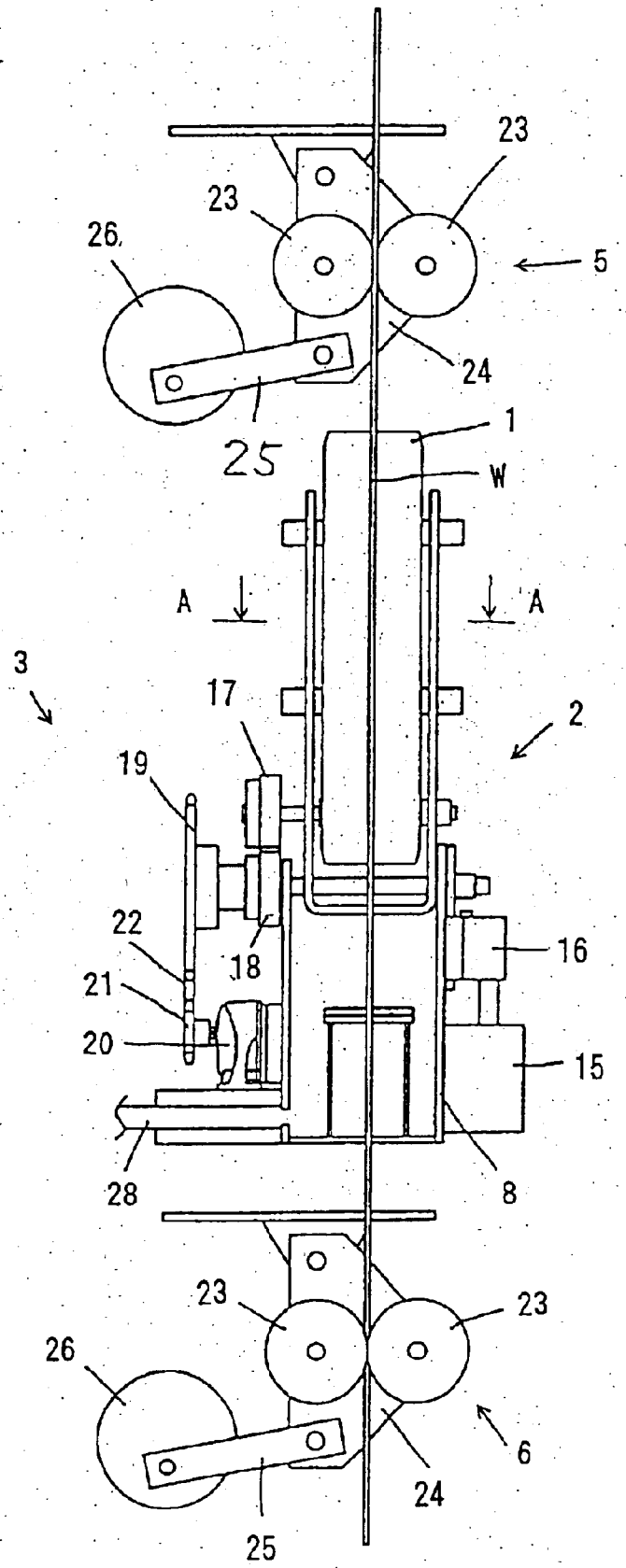
FIG. 1 is a partial front view to show a first embodiment of this invention.

A first embodiment of the apparatus of this invention for surface processing a long piece of material will now be detailed in reference to FIGS. 1–4. As is shown in FIG. 1, the surface processing apparatus comprises two elastic endless belts 1/1 (see FIG. 2) that face each other to be able to hold a wire rod W, as a long piece of material, between them, approaching/separating means for causing the belts to approach and separate from each other (see FIG. 2), rotating means 3 for rotating the elastic endless belts, nozzles 4/4 for blowing powder/particle abrasives between the belts (see FIG. 2), and reciprocating means 5/6 for reciprocating the long piece of material in the longitudinal direction of the elastic endless belts.

The elastic endless belts 1/1 are equipped with a plurality of grooves 7 for holding abrasives: the grooves are substantially equidistantly disposed in a direction perpendicular to the direction of the movement of the belts.

Figure 2:
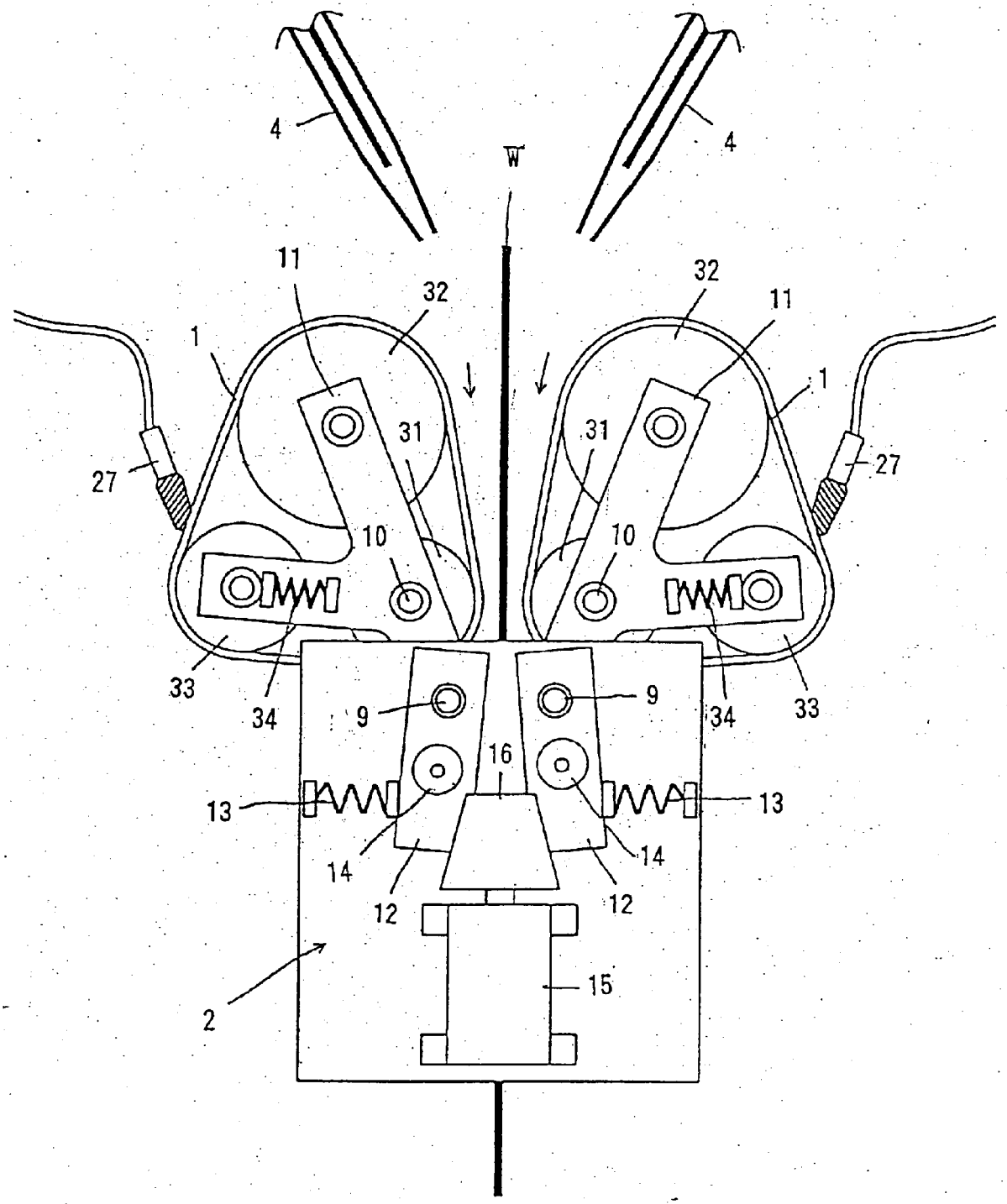
FIG. 2 is a right side view of the main part of FIG. 1.
Figure 3:
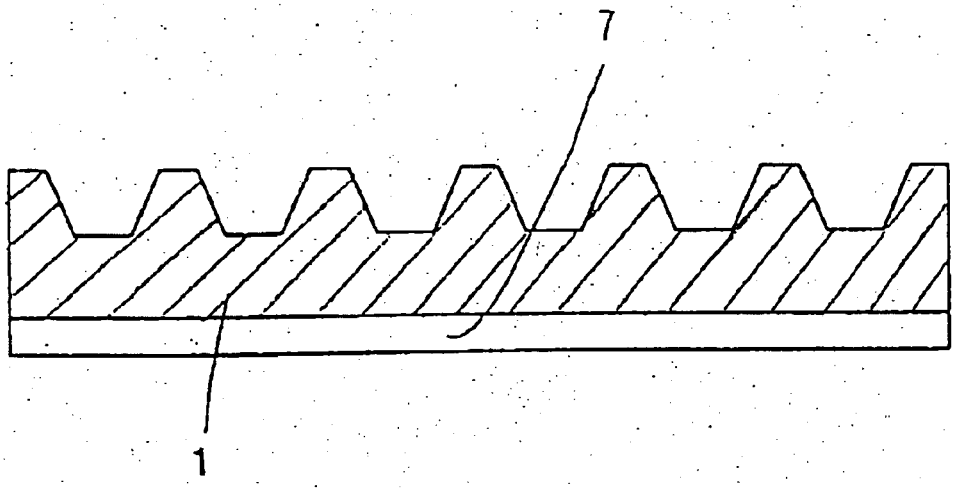
FIG. 3 is an enlarged cross section of FIG. 1 cut along the line A—A to show its details.
Figure 4:
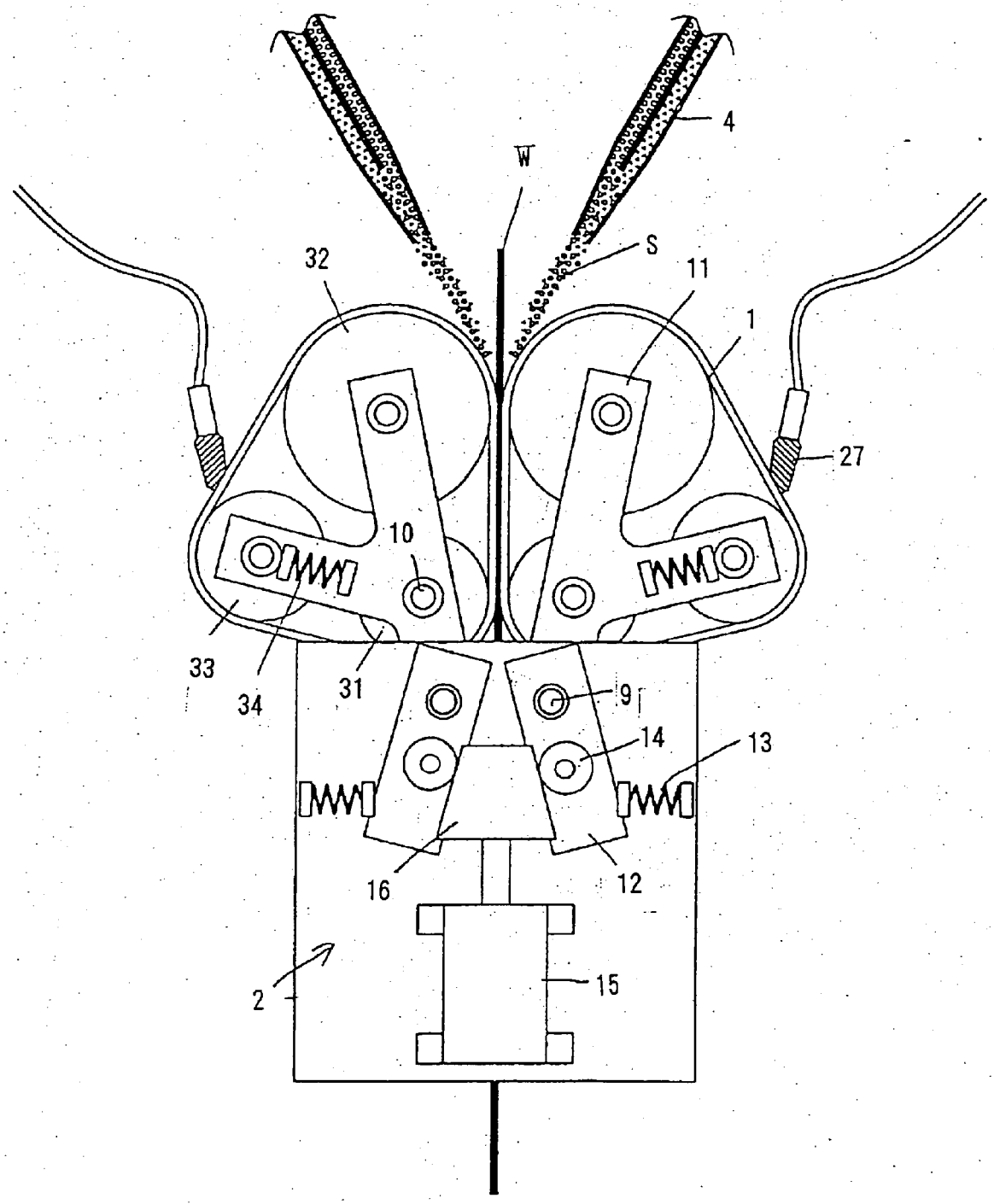
FIG. 4 is a schematic to explain the operation of surface processing the wire rod of FIG. 2.

As is shown in FIGS. 1 and 2, the approaching/separating means 2 consists of 1) supporting means 11/11 for supporting Y-shaped belt pulleys 31–33: supporting means that face each other in a stationary box-like supporting frame 8, and is supported via supporting shafts 9/9 to be rotated freely; and the two elastic endless belts 1/1 are mounted on its upper part via three belt pulleys 31–33 to be rotated freely; 2) two arms 12/12, which face each other to form an inverse V-shape, and each upper end of which is engaged with front ends of the supporting shafts 9/9; 3) compressed coil springs 13/13, mounted on the supporting frame 8 to urge the lower ends of the two arms 12/12 toward the inside; 4) two guide rollers 14/14 pivoted respectively on the lower parts of the two arms 12/12; 5) an upward cylinder 15 mounted on a position just between the two guide rollers 14/14 in the supporting frame 8; 6) and a wedge 16 engaged with the front end of the cylinder 15 and disposed between the two guide rollers 14/14. The up-and-down movement of the wedge 16 by the expansion/contraction movement of the cylinder 15 causes the two elastic endless belts 1/1 to approach each other or separate from each other by the supporting shafts 9/9 operating as a fulcrum.

The belt pulleys 31–33 are used for driving, being driven and pulling: the belt pulley 33 for pulling use is urged toward the outside by a compressed coil spring 34.

The rotating means 3, as is shown in FIG. 1, comprises a gear 17 engaged with each left end of shafts 10/10 of the driving belt pulley 31; pinions 18/18 engaged with each left end of the supporting shafts 9/9; a chain wheel 19 engaged with the left end of one of the supporting shafts 9/9; an electric motor 20 with a speed reducer separately and fixedly disposed; a chain wheel 21 engaged with the output shaft of the motor 20; and an endless roller chain 22 spanning the two chain wheels 19/21: the pinions 18/18 engage with each other so that the two elastic endless belts 1/1 rotate inwardly respectively as shown in FIG. 2 by the operation of the motor 20.

The reciprocating means 5/6, as shown in FIG. 1, are disposed far apart at positions above and under the approaching/separating means 2, respectively. Each of reciprocating means 5/6 comprises a pair of rollers 23/23 which guide a wire rod W while it is pivoted and held between the rollers; a swinging frame 24 which is supported to be freely swung left and right, and on which the pair of rollers 23/23 are pivoted; and swinging means 5 for swinging the swinging frame 24 and the pair of rollers 23/23 by the crank movement generated by the rotation of a rotary plate 26 and a link 25. As shown in FIG. 2, the two elastic endless belts 1/1 are equipped with wetting means 27/27 to wet the belts. Further, as shown in FIG. 1, an absorbing pipe 28, which communicates with absorbing means (not shown) of a recovery means for absorbing and recovering abrasives gathered in the supporting frame 8, is connected in the bottom of the box-like supporting frame 8.

A procedure for surface processing a wire rod as a long piece of material by the thus-constituted apparatus of this invention will now be explained. The wire rod is sequentially passed between the pair of rollers 23/23 in the upper reciprocating means 5, between the two elastic endless belts 1/1 and between the pair of rollers 23/23 in the lower reciprocating means 6; simultaneously the wire rod is held by the two pairs of rollers 23/23 of both the upper and lower reciprocating means; and then the wire rod is pulled down by lower pulling means (not shown) while the wire rod is reciprocated by the swinging means 26/26 in a lateral direction along the width of the elastic endless belts 1/1. The lateral reciprocating movement of the wire rod in the width direction of the elastic endless belts 1/1 can curb the local wear in the peripheries of the elastic endless belts.

In this state, the two elastic endless belts 1/1 approach each other while the supporting shafts 9/9 act as a fulcrum triggered by the rise of the wedge 6 caused by the expanding operation of the cylinder 15 so as to hold the wire rod W by the given strength exerted by the elastic endless belts 1/1; the elastic endless belts 1/1 are then rotated in the directions as indicated by the arrows (FIG. 2) by driving the electric motor 20 of the rotating means 3 so that the speed of rotation of the elastic endless belts become faster or slower than the speed of the movement of the wire rod W; and powder/particle-like abrasives S/S are blown between the elastic endless belts 1/1.

The wire rod is thus held by the elastic endless belts 1/1 for a relatively long time, abrasives S/S are kept within the grooves 7/7 of the elastic endless belts 1/1 for a given time, and abrasives are securely attached to the elastic endless belts 1/1 wetted by the wetting means 27/27. As the result of this, the wire rod W is moved by the elastic endless belts 1/1 relative to the wire rod W so as to be rubbed and surface finished by the abrasives S/S. The abrasives S/S that have gathered in the supporting frame 8 since they were blown thereinto from the nozzles 4/4 are recovered by the absorbing pipes 28.

Although in the above embodiment two elastic endless belts 1/1, facing each other, are used, three or more elastic endless belts may be used depending on the dimensions of the long piece of material to be processed.

Figure 5:
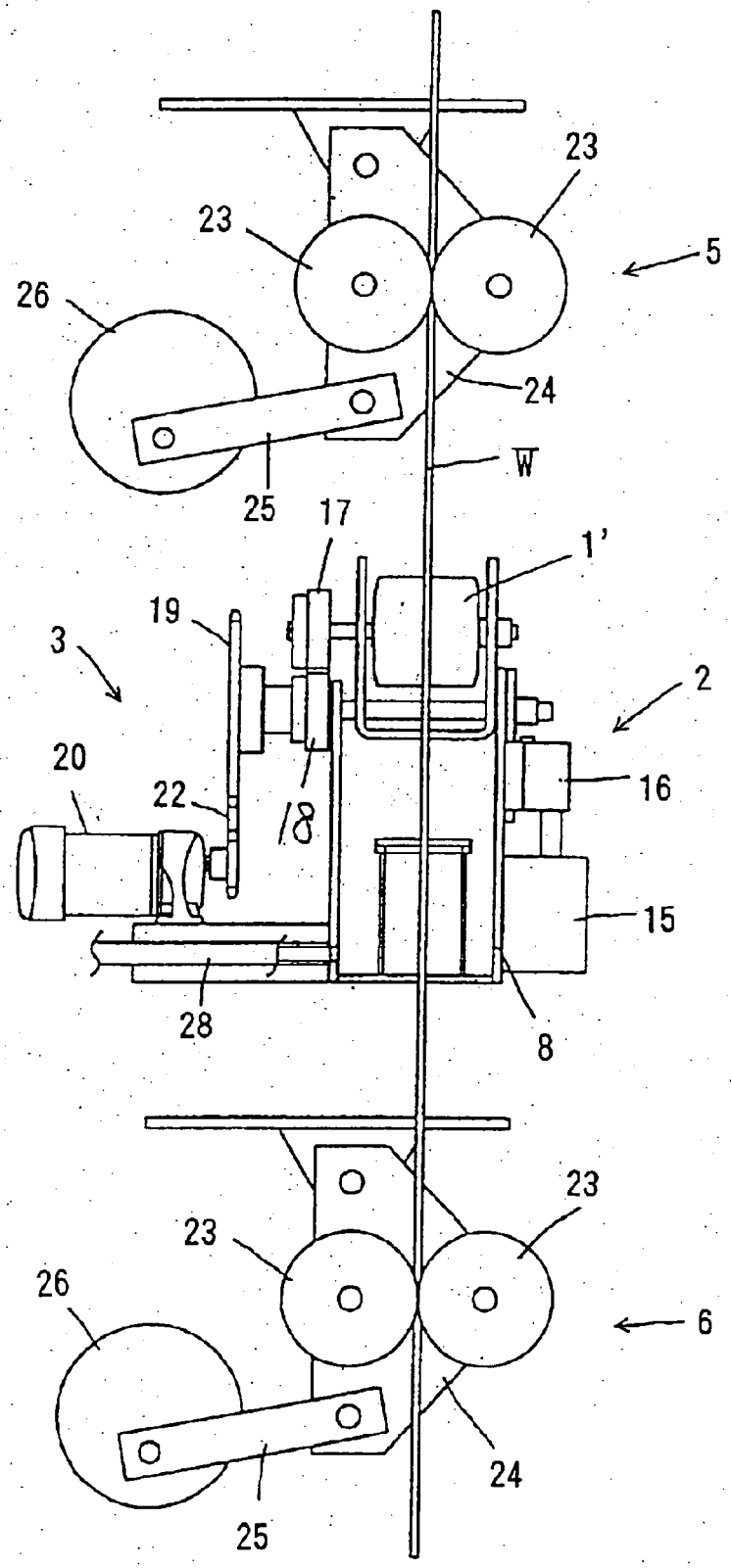
FIG. 5 is a partial front view to show a second embodiment of this invention.

In reference to FIGS. 5–9, a second embodiment of the surface processing apparatus according to this invention will now be explained. As shown in FIG. 5, the surface processing apparatus comprises two elastic rollers 1'/1' (see FIG. 6) which face each other so as to be able to hold a wire rod as a long piece of material between them; approaching/separating means 2 for causing the two rollers 1'/1' to approach and separate from each other (see FIG. 6): rotating means 3 for rotating the elastic rollers 1'/1'; nozzles 4/4 (see FIG. 6) for blowing or putting powder/particle-like abrasives between the elastic rollers 1'/1'; and reciprocating means 5, 6 for reciprocating the long piece of material in the longitudinal direction of the elastic rollers 1'/1'. The elastic roller 1', as shown in FIG. 8, has a number of grooves 7/7 for holding abrasives. The grooves that extend in the same direction as the shaft of the roller are disposed almost equidistantly in the peripheral surface of the roller.

Figure 7:
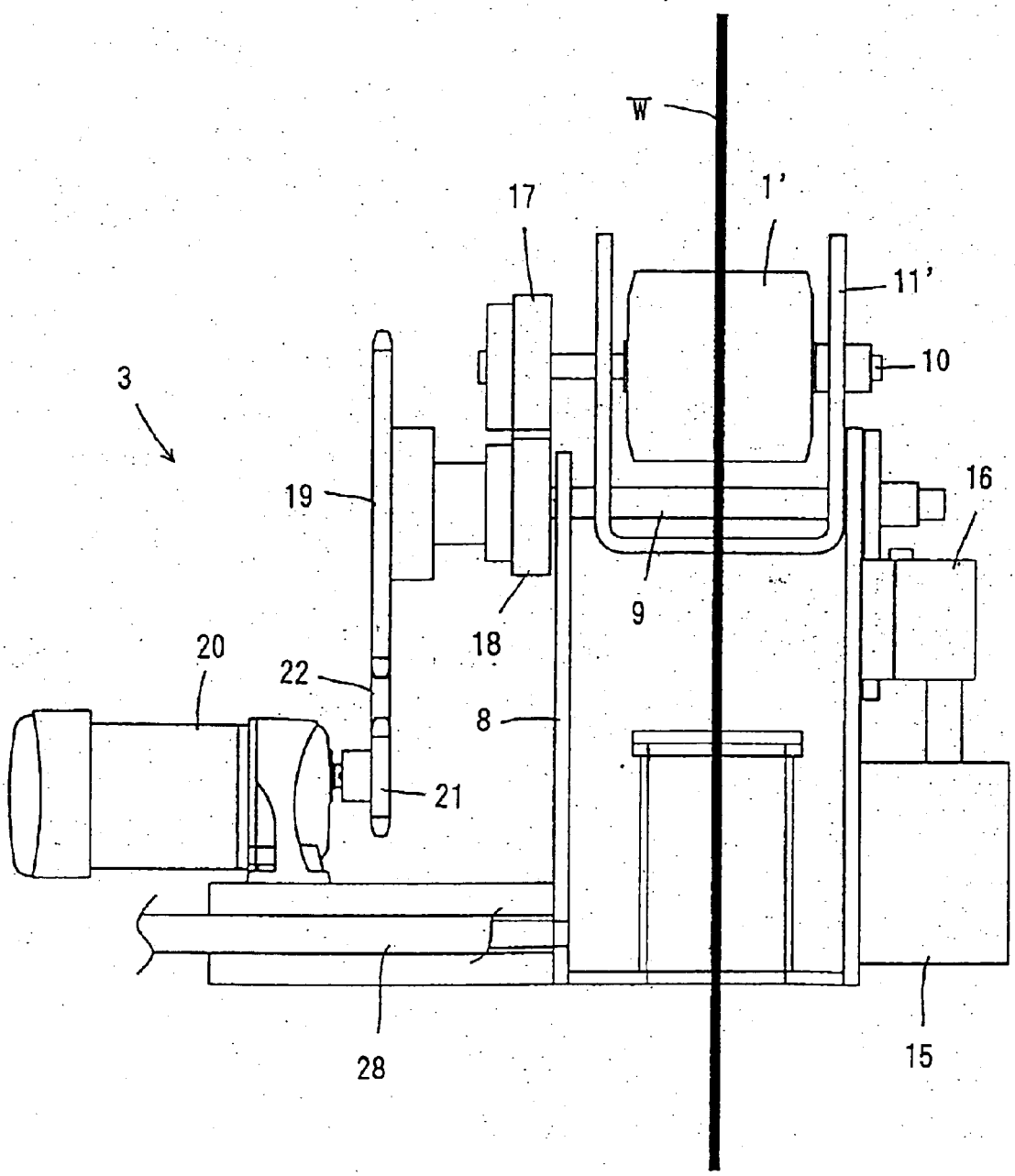
FIG. 7 is a cross section of FIG. 6 cut along the line A—A.

As is shown in FIGS. 6 and 7, the approaching/separating means 2 consists of 1) roller supporting means 11'/11' for supporting two elastic rollers 1'/1': each supporting means faces each other above a stationary box-like supporting frame 8 (see FIG. 6), and is supported via supporting shafts 9/9 to be rotated freely in a vertical direction; and the two elastic rollers 1'/1' are mounted on its upper part via shafts 10/10 to be rotated freely; 2) two arms 12/12, which face each other to form an inverse V-shape, and each upper end of which is engaged with front ends of the supporting shafts 9/9; 3) compressed coil springs 13/13 mounted on the supporting frame 8 to urge the lower ends of the two arms 12/12 toward the inside; 4) two guide rollers 14/14 pivoted respectively on the lower parts of the two arms 12/12; 5) an upward cylinder 15 mounted on a position just under and between the two guide rollers 14/14 in the supporting frame 8; 6) and a wedge 16 engaged with the front end of the cylinder 15 and disposed between the two guide rollers 14/14. The up-and-down movement of the wedge 16 by the expansion/contraction movement of the cylinder 15 causes the two elastic rollers 1'/1' to approach or separate from each other by the supporting shafts 9/9 operating as a fulcrum.

The rotating means 3, as shown in FIG. 7, comprises a gear 17 engaged with each left end of the shafts 10/10; pinions 18/18 engaged with each left end of the supporting shafts 9/9; a chain wheel 19 engaged with the left end of one of the supporting shafts 9/9; an electric motor 20 with a speed reducer separately and fixedly disposed; a chain wheel 21 engaged with the output shaft of the motor 20; and an endless roller chain 22 spanning the two chain wheels 19/21: the pinions 18/18 engage with each other so that the two elastic rollers 1'/1' rotate inwardly as shown in FIG. 6, by the operation of the motor 20.

The reciprocating means 5/6, as shown in FIG. 5, are disposed distantly above and under the approaching/separating means 2, respectively. Each of the reciprocating means 5/6 comprises a pair of rollers 23/23 which guide a wire rod W while it is being pivoted and held between the rollers; a swinging frame 24 which is supported to be freely swung in left and right directions, and on which the pair of rollers 23/23 are pivoted; and swinging means 5 for swinging the swinging frame 24 and the pair of rollers 23/23 by the crank movement generated by the rotation of a rotary plate 26 and a link 25.

As shown in FIG. 6, the two elastic rollers 1'/1' are equipped with wetting means 27/27 to wet the belts. Further, as shown in FIG. 7, an absorbing pipe 28, which communicates with absorbing means (not shown) of recovery means for absorbing and recovering abrasives gathered in the supporting frame 8, is connected in the bottom of the box-like supporting frame 8.

A procedure for surface processing a wire rod as a long piece of material by the thus-constituted apparatus of this invention will now be explained. The wire rod is sequentially passed between the pair of rollers 23/23 in the upper reciprocating means 5, between the two elastic rollers 1'/1' and between the pair of rollers 23/23 in the lower reciprocating means 6; simultaneously the wire rod is held by the two pairs of rollers 23/23 of both the upper and lower reciprocating means; and then the wire rod is pulled down by lower pulling means (not shown) while the wire rod is reciprocated by the swinging means 26/26 in a lateral direction along the width of the elastic rollers 1'/1'. The lateral reciprocating movement of the wire rod in the width direction of the elastic rollers 1'/1' can curb the local wear in the peripheries of the elastic rollers.

In this state, the two elastic rollers 1'/1' approach each other while the supporting shafts 9/9 act as a fulcrum triggered by the rise of the wedge 6 caused by the expanding operation of the cylinder 15 so as to hold the wire rod W by a given magnitude of force exerted by the elastic rollers 1'/1'; the elastic rollers are then rotated in the directions as indicated by the arrows (FIG. 6) by driving the electric motor 20 of the rotating means 3 so that the speed of rotation of the elastic rollers become faster or slower than the speed of the movement of the wire rod W; and powder/particle-like abrasives S/S are blown between the elastic rollers 1'/1'.

The elastic rollers 1'/1' are adapted to the shape of the wire rod by the deformation of the portions of its periphery that contact each other; thus the wire rod is held by the elastic rollers 1'/1' for a relatively long time, the abrasives S/S are kept within the grooves 7/7 of the elastic rollers for a given time; and the abrasives are securely attached to the elastic rollers 1'/1' wetted by the wetting means 27/27. As a result of this, the wire rod W is moved by the elastic rollers 1'/1' relative to the wire rod W so as to be rubbed and surface finished by the abrasives S/S. The abrasives S/S that have gathered in the supporting frame 8 since they were blown thereinto from the nozzles 4/4 are recovered by the absorbing pipes 28.

Although in the above embodiment two elastic rollers 1'/1', facing each other, are used, three or more elastic rollers may be used depending on the dimension of the long piece of material to be processed.

In reference to FIGS. 10 and 11, we will now detail a third embodiment of the apparatus of this invention suitable for surface processing a long piece of material. As shown in FIG. 10, the surface processing apparatus comprises two pairs of surface processing means 41,42. They contain abrasives that can be pressurized therein, and through which a long piece of material W extending vertically is passed; rotating means 43 for rotating the surface processing means 41,42 at a low speed centering around the long piece of material W in two directions opposite each other; and supply/discharge means (not shown) for supplying abrasives to and discharging the abrasives from each of the surface processing means 41,42.

As shown in FIG. 11, each of the two pairs of surface processing means 41,42 comprises a cylindrical supporting member 44 rotatably supported by two ball bearings 45/45; two closing members 48,49, each of which has inlet and outlet openings 46,47 for the long piece of material W, mounted on both the upper and lower sides of the supporting member 44; a hollow tubular member 51 that spans the two closing members 48,49 for accommodating powder/particle-like abrasives 50 as a flexible container; and pressing means 52 for pressing and holding the flexible tubular means 51 from two opposite directions.

As shown in FIG. 10, the rotating means 43 comprises two umbrella-toothed wheels 53/53 engaged with the supporting members 44/44 at opposite sides of the two pairs of surface processing means 41,42; an electric motor 54 with a speed reducer disposed between the two pairs of surface processing means 41,42; and an umbrella-toothed wheel 55 that is engaged with the output shaft of the electric motor 54 that is also engaged with the umbrella-toothed wheels 53/53 so as to rotate the surface processing means 41,42 in opposite directions.

As shown in FIG. 10, the pressing means 52, which is mounted on the outside surface of the supporting member 44, comprises two opposing short cylindrical pressing bodies 56/56; forward/backward means 57, mounted on the supporting means 44, for pivoting the pressing bodies 56/56 and for pressing the pressing bodies 56/56 against the outer surface of the flexible tubular means 51, and for separating them therefrom; and cylinders 58/58 mounted on the supporting means 54 for operating the forward/backward means 57. Thus, the pressing bodies 56/56 are pressed against and separated from the flexible tubular means 51 via the forward/backward means 57, respectively.

The proper fluidity of the powder/particle-like abrasives 50 within the flexible tubular member 51 can be easily maintained by providing it a with a cylindrical profile by means of the pressing bodies 56/56. Further, the magnitude of the pressure exerted by the pressing bodies 56/56 can be controlled by adjusting the amount of force generated while the cylinder 58 is being expanded.

As shown in FIG. 10, the two pairs of surface processing means 41,42 are disposed vertically in series, and the pressing means 52/52 therefor can be shifted apart from each other by about 90 degrees, namely, they can be rotated while being centered around the long piece of material. Further, the supply/discharge means communicate with a supply inlet 59 and a discharge outlet 60 disposed in each of the respective flexible tubular member 51.

A procedure for surface processing the long piece of material W by the thus-constituted apparatus will now be explained. First, the long piece of material W is passed through, in this order: an inlet opening 46 of the closing member 48 in the upper surface processing means 41, the flexible tubular member 51, and an outlet opening 47 in the closing member 47, and then the long piece of material W is similarly passed through the lower surface processing means 42. Next, powder/particle-like abrasives 50 are supplied from a supply inlet 59 to the flexible tubular member 51 by the supply/discharge means in the upper surface processing means 41 to fill the flexible tubular member 51, and the discharge outlet 60 is then arranged such that the powder/particle-like abrasives 50 can be freely discharged therethrough, and such that the outer surface of the flexible tubular member 51 and a part of the abrasives 50 are continuously pressed by the pressing bodies 56/56 of the pressing means 52.

In this case, the magnitude of the pressing force exerted by the expansion of the cylinder 58 against the abrasives 50 is controlled such that it lies within a range wherein the long piece of material can only be moved when it is drawn, and such that it becomes that of a magnitude that corresponds to the purpose for surface finishing the long piece of material. In this state, the two pairs of surface processing means 41,42 are rotated in opposite directions by pulling down the long piece of material by conventional means (not shown), and by operating the electric motor 54 with a speed reducer. The rotating long piece of material is thus surface processed by abrasives, and then the impurities, namely, the fragments scraped from the long piece of material, are discharged from the outlet 60 along with the abrasives. When frictional heat is generated by the movement of the long piece of material under the pressure exerted by the abrasives, cooling gas such as compressed air, carbon dioxide, etc. is supplied at need.

Although two pressing bodies 56/56 facing each other are used in this embodiment, three or more pressing bodies may be used depending on the dimensions in cross section of the long piece of material. Further, although the abrasives 50 are supplied to and discharged from the flexible tubular member 51 in the above embodiment, when there is no special need for abrasives to be supplied/discharged, on such an occasion and when a long piece of material with a small cross section is polished, the long piece of material W may be moved relative to the flexible tubular member 51 that accommodates the abrasives 50. In the above embodiment, the abrasives that are supplied from the inlet opening 46 may be wetted by wetting means (not shown).

In reference to FIG. 12, a fourth embodiment of this invention, which is exemplified therein, will now be explained.

A container 61 for accommodating abrasives comprises a flexible chamber 66 that can be expanded and contracted, a pressurizing chamber 67, a sending-in chamber 68, and an air-absorbing chamber 69. The chambers 66 and 68 are partitioned by a plate 70A having an opening 63D for passing a long piece of material; the chamber 66A and air-absorbing chamber 69 are partitioned by a plate 70B having an opening 63B for passing the long piece of material.

Openings 63A, 63C, through which long pieces of material are passed, are disposed in the sidewalls 62/62 of the container 61. The flexible chamber contains polygonal powder/particle-abrasives 64, the converted diameter of which is 0.02–2.5 mm. Seals 65/65, which comprise rubber plates or brushes for effectively preventing the abrasives 64 from leaking, are disposed in the inside of the openings 63A and 63C. A seal 65 is also disposed in the inside of the opening 63B.

The sending-in chamber 68 communicates with a fine-powder separator (not shown) via a pipe 71A, so that polishing powder/particles are supplied from the separator thereto. The air-absorbing chamber 69 communicates with the fine-powder separator by a pipe 71B. A sedimentation box 72 is disposed midway along the pipe 71B, and the bottom of it communicates with the fine-powder separator (not shown). The ceiling 72A or the sidewall 72B of the sedimentation box 72 has a duct 73 which communicates with a dust collector (not shown), which in turn communicates with a high-pressure blower (not shown).

The chamber 66 is constituted flexibly in terms of its material and shape. In the embodiment of this invention, the chamber 66 is made of rubber, and a pipe-like shape and a plate-like shape are adopted. The pressurizing chamber 67 is constituted by rubber, and it can be expanded/contracted by the pressurization from a gas or fluid, which communicates with a pressurizing pump via piping 73. Although the chamber 66 and the pressurizing chamber 67 are constituted as a single unit in the container 61 in this embodiment, they may be constituted by a plurality of units to be used successively.

Below we explain the embodiment in reference to FIGS. 12, 13, and 14. FIG. 13 shows a cross section of the container 61, prior to pressurization, cut along the line A—A. FIG. 14 shows the same after pressurization. While the long piece of material W is kept in the container filled with powder/particle abrasives 64, the pressurizing chamber 67 can be expanded by introducing pressurized fluid or air thereinto. This expansion pressurizes the powder/particle abrasives 64, and the surface of the long piece of material W as well by means of the flexible chamber 66.

Below we explain the operation of the thus-constituted embodiment. In this state, the long piece of material W is pulled by the operation of a work-transporter (not shown), and is passed through the pressurized powder/particle abrasives 64. At this time the surface of the work W is scratched or polished by the polygonal, abrasive powder/particle abrasives 64. A part of the powder/particle abrasives 64 is moved along with the work W towards the partition plate 70B, their major part remaining in the chamber 66 due to the seals 65, and the remaining part is absorbed through the gap between the seal 65 and work W into the air-absorbing chamber 69 with the absorbing air.

The absorbing air is absorbed from the gap of seals 65 at the opening 63A for passing work in the container 61, and then is sent via the sending-in chamber 68, the opening 63D for passing work in the partition plate 70A of the inlet-opening side of the chamber 66, the inside of the powder/particle abrasives 64, and the opening 63B for passing the work in the partition plate 70B of the outlet opening side of the chamber 66, to the air-absorbing chamber 69. In other words, when the absorbing air passes through the inside of the powder/particle abrasives 64 in the chamber 66, it moves the fine powder generated by wear and odd matter or fragments scraped from the surface of the work W, etc., in the direction of the advance of the flow so as to be sequentially sent into the air-absorbing chamber 69.

The powder/particles 64, fine powder, odd matter or powder scraped from the work, etc., that are sent into the air-absorbing chamber 69, are sent by air into the sedimentation box 72 via the pipe 71B. The coarse and fine substances gathered in the box 72 are then recovered by a fine powder separator and a dust collector, respectively.

When the work W passes through the sending-in chamber 68, the powder/particles 64 supplied from the fine powder separator via the pipe 71A are continuously introduced and supplied into the chamber 66 by means of a contacting force and the absorbed air. The powder/particles 64 sent into the chamber 66 contact the work W, and move at a speed slower than that of the work W being transported in the direction of its advance. As the powder/particles 64 circulate through the fine-powder separator, the sending-in chamber of the container 61, the chamber 66, the air-absorbing chamber 69, the sedimentation box 72 and again the fine-powder separator, the polishing by the powder/particles can be continuously carried out.

Although the total amount of the circulating powder/particles is reduced due to the recovery of fine powder therefrom, the total amount circulating can be maintained because a hopper of the fine-powder separator is equipped with a fine-powder supplier for adjusting the total amount circulating so as to appropriately supplement new powder/particles at need.

Even if a soft and elastic material is mixed with the powder/particles 64, there is no need to change their constitution or function. Such a mixture has an advantage in that it effectively delivers the pressurized force to uniformly press the surface of the work.

Since the apparatus and method for carrying out the surface processing of this invention need no means for rotating cutting tools, rubbing-stones, brushes, etc., at a high speed, and need no sound-proofing equipment, the apparatus and method can be constituted in a very simple and compact structure.

By the way, the foreign substances that adhere to a long piece of material include lubricating oil, a counteragent, a plating film, a plastic film, etc., and that are formed on a long piece of material include a chemically processed film, a deposited film, an impregnated film, etc.

Effects of the Invention

As is clear from the above explanation, this invention has excellent practical effects in that it can securely surface process a long piece of material without causing any environmental problem, and without reducing the mechanical quality of the long piece of material. This invention can continuously envelope the entire peripheries of a long piece of material having a polygonal continuous cross section with powder/particles, the hardness of which is higher than that of the surface of the long piece of material, and can hold it while having the powder/particles contact its surface by selectively pressing them thereto. Since in this invention, while the above-mentioned state is maintained only the long piece of material is moved to polish its surface, it can carry out the surface processing faster and cheaper compared with the conventional method that uses tools such as a cutting tool, a rubbing-stone or a brush, etc.

Further, since this surface processing method uses powder/particles instead of a cutting tool, rubbing-stone or brush, etc., any long piece of material having a uniform or small cross section that could not have been processed by the conventional method can be surface processed by this invention without any such limitations. Electric power consumption has significantly been reduced as an effect accompanied by this invention, since there is no need for rotating or reciprocating cutting tools as used conventionally. Thus, this invention has great effects in terms of energy saving, safety, running costs, and the environment.

Further, since this invention can control the amount of substance to be cut from the surface of the processed material, and further, can make a streak, by selecting an abrasive material, a shape, the size of particles, etc., according to the quality, surface hardness and profile of the long piece of material and the purpose of processing, and by definitely selecting the amount of force to hold the long piece of material and the number of rotations of the endless belts, when a drawing or rolling process is carried out later wet or dry lubrication oil can be more effectively introduced to the portion for processing tools compared to the pickling process. Further, since the streaks generated by this invention are suitable for the prearrangement for chemical coating or paints, and since the apparatus of this invention can be more compact compared with the pickling method or other wet washing method, an in-line surface processing apparatus can be realized.

What is claimed is:

1. A method for surface processing a long piece of material, comprising the steps of holding a long piece of material between at least two elastic endless belts with a given magnitude of force, rotating the elastic endless belts in a direction identical to a direction of movement of the long piece of material or a direction opposite to the direction of the movement of the long piece of material such that a speed of rotation of the elastic endless belts becomes faster or slower than a speed of movement of the long piece of material while the long piece of material is being moved, and throwing powder particulate abrasives between the elastic endless belts to thereby abrasively surface process the long piece of material while moving the abrasives relative to the long piece of material, wherein the step of surface processing the long piece of material further includes a step of wetting the elastic endless belts.

2. The method of claim 1, wherein the elastic endless belts are elastic rollers.

3. The method of claim 1 or 2, wherein the abrasives are blown between the elastic endless belts.

4. The method of claim 1 or 2, wherein either soft or hard abrasives or a mixture thereof are used as the abrasives.

5. The method of claim 1 or 2, wherein a particle diameter of the abrasives is from 0.02 to 2.5 mm.

6. The method of claim 1, wherein the surface processing is surface roughening.

7. The method of claim 1, wherein the surface processing is surface polishing.

8. The method of claim 1, wherein the surface processing is an in-line surface processing.

9. An apparatus for surface processing a long piece of material, comprising at least two elastic endless belts facing each other for holding a long piece of material between the belts, the at least two elastic endless belts being rotatable in a direction identical to a direction of movement of the long piece of material or a direction opposite to the direction of the movement of the long piece of material, approaching/separating means for causing the at least two elastic endless belts to approach each other or separate from each other, means for throwing powder particulate abrasives between the at least two elastic endless belts while the long piece of material is being held between the elastic endless belts, means for reciprocating the long piece of material being held between the at least two elastic endless belts, and means for wetting the elastic endless belts.

10. The apparatus of claim 9, wherein the elastic endless belts are elastic rollers.

11. The apparatus of claim 9 or 10, wherein a plurality grooves for holding the abrasives are disposed on the surface of the elastic endless belts.

* * * * *